US008708311B2

(12) United States Patent
Coupe

(10) Patent No.: US 8,708,311 B2
(45) Date of Patent: Apr. 29, 2014

(54) E-ZEE PUSH

(76) Inventor: Thomas Shelton Coupe, Castro Valley, CA (US)

( * ) Notice: Subject to any disclaimer, the term of this patent is extended or adjusted under 35 U.S.C. 154(b) by 339 days.

(21) Appl. No.: 13/007,978

(22) Filed: Jan. 17, 2011

(65) Prior Publication Data

US 2012/0181491 A1 Jul. 19, 2012

(51) Int. Cl.
*B66F 15/00* (2006.01)

(52) U.S. Cl.
USPC ..... 254/25; 269/6

(58) Field of Classification Search
USPC ..... 254/133 R, 21, 25; 269/8, 3, 6, 95
See application file for complete search history.

(56) References Cited

U.S. PATENT DOCUMENTS

| | | | | |
|---|---|---|---|---|
| 6,524,035 | B1 * | 2/2003 | Robison | 408/211 |
| 2003/0110906 | A1 * | 6/2003 | Li et al. | 81/177.1 |
| 2010/0132161 | A1 * | 6/2010 | Vu | 16/404 |
| 2012/0181491 | A1 * | 7/2012 | Coupe | 254/133 R |

* cited by examiner

*Primary Examiner* — Lee D Wilson

(57) ABSTRACT

The normal process for installing and removing push pins are with the fingers and after repeating this process several times the fingers may become tired or sore. With the E-Zee Push device the push pin is inserted into one end of the device and the device is used to easily push the pin into a soft to semi-hard surface. The other end has grooves that fit over the push pin and makes it easy to pull the push pin out. Sometimes when picking up push pins the pointed end of the push pin may stick you. E-Zee Push has an attached magnet, which is able to pick up several push pins at one time without the danger of being stuck and making them easily accessible while installing objects to the desired surface.

3 Claims, 1 Drawing Sheet

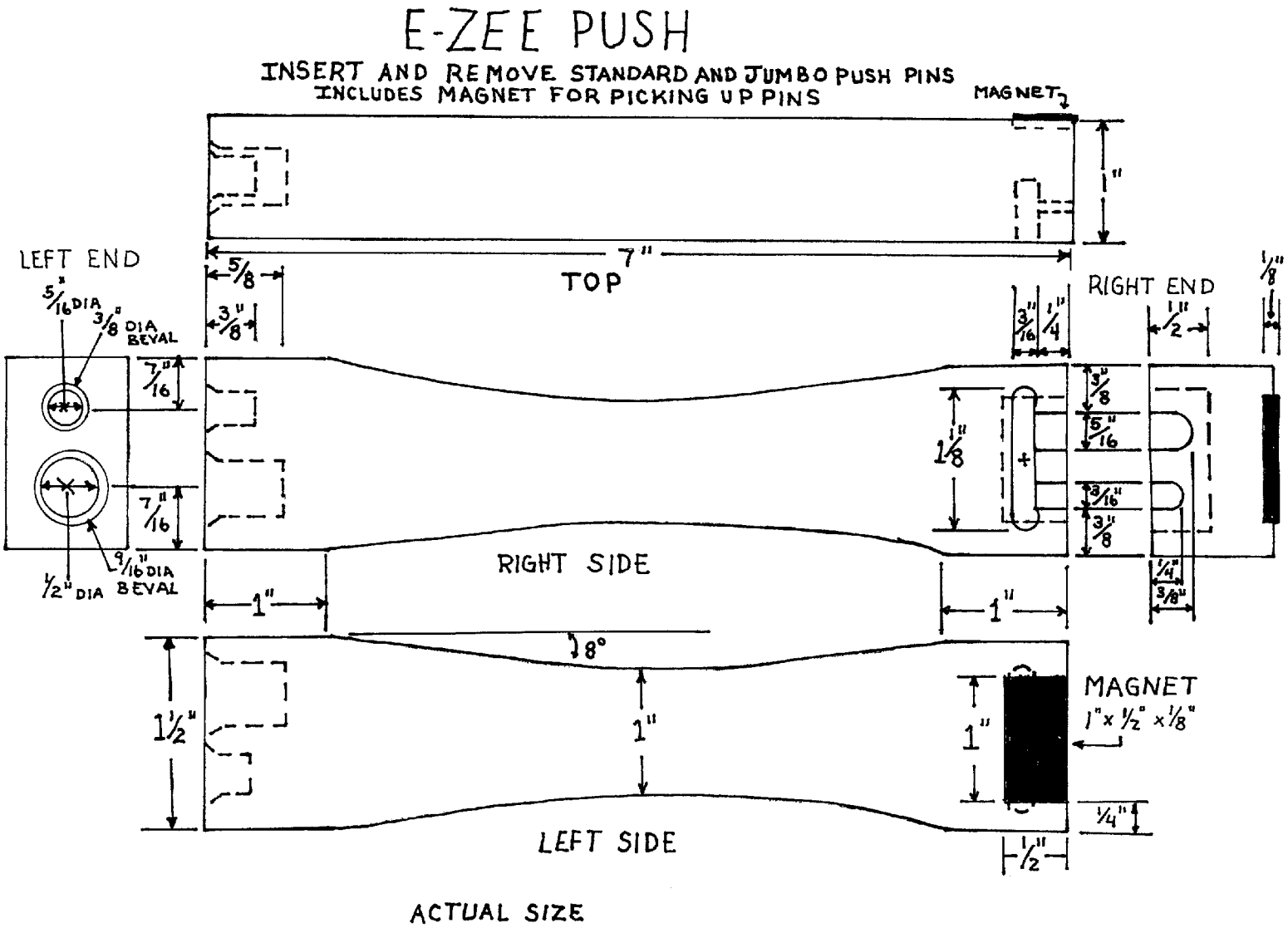
E-ZEE PUSH
INSERT AND REMOVE STANDARD AND JUMBO PUSH PINS
INCLUDES MAGNET FOR PICKING UP PINS
MAGNET
TOP
RIGHT END
RIGHT SIDE
LEFT SIDE
MAGNET
1" x 1/2" x 1/8"
LEFT END
ACTUAL SIZE

E-ZEE PUSH

CROSS-REFERENCE TO RELATED APPLICATIONS

"Not Applicable"

STATEMENT REGARDING FEDERALLY SPONSERED RESEARCH OR DEVELOPMENT

"Not Applicable"

REFERENCE TO SEQUENCE LISTING, A TABLE, OR A COMPUTER PROGRAM LISTING COMPACT DISC APPENDIX

"Not Applicable"

BACKGROUND OF THE INVENTION

"Not Applicable"

BRIEF SUMMARY OF THE INVENTION

A 7"×1½"×1" piece of hard plastic designed in such a way as to facilitate in the installation and removal of standard and jumbo size pushpins into soft to medium hard surfaces. A magnet is attached which allows several pushpins to be picked up at one time.

BRIEF DESCRIPTION OF THE SEVERAL VIEWS OF THE DRAWING

FIG. 1

Top view shows height and length.

Right side and both ends show measurements for push pin holes, push pin removal grooves and depth for magnet.

Left side shows width for both ends, beveled handhold and magnet size and placement.

DETAILED DESCRIPTION OF THE INVENTION

This device aids in the installation, and removal of standard and jumbo size push pins. A magnet is attached which will allow several push pins to be picked up at one time. Device is a 7"×1½"×1" piece of hard plastic.

Top and bottom sides are beveled to create a handhold. Bevel starts 1" in from each end and levels out to 1" width in the center.

Left end has two holes for inserting standard and jumbo size pushpins. Standard size hole has a 5/16" diameter, drilled 3/8" deep. 5/16" hole is centered ½" in from the side and 7/16" from the top. Top of the hole has a 3/8" diameter bevel.

Jumbo size hole has a 7/16" diameter drilled 5/8" deep. 7/16" hole is centered ½" from the side and 7/16" from the bottom. Top of the hole has a 9/16" diameter bevel.

Right side, right end has two slots for removing standard and jumbo size pushpins. Standard size slot is 3/16" wide, ¼" long and ¼" deep. Standard size slot starts at the right end and 3/8" in from the bottom.

Jumbo size slot is 5/16" wide, ¼" long and 3/8" deep. Jumbo size slot starts at the right end and runs along the right side, 3/8" in from the top. There is a slot on the right side that runs from top to bottom at the end of the standard and jumbo slots. This slot is 3/16" wide, 1⅛" long (from top to bottom) and ½" deep. The right side of the slot is to be ¼" in from the right end so that the other two slots join into it creating an opening from the two slots. The 1⅛" slot is to be centered from top to bottom.

Left side, right end (end with the slots) has an attached magnet for picking up several push pins at one time. Magnet is 1"×½"×⅛". A recessed area is provided to permanently attach the magnet to the device. The recessed area is to be the same dimensions as the magnet and mounted flush to the right end and centered from top to bottom with the 1" length running from top to bottom.

I claim:

1. An apparatus for installing and removing pins said apparatus comprising:

a body being an elongated member with cylindrical first top end and second bottom ends and a tapered middle center portion;

a magnet being in a recess of said first top end;

a slot within a side of said first top end which exposes said magnet recessed within a top portion of said first end;

a plurality of orifices each orifice being of different sizes in a bottom of said bottom second end a side of said first top end which exposes said magnet.

2. The apparatus according to claim 1 wherein said body is made out of a plastic.

3. The apparatus according to claim 1 wherein said plurality of said orifices have a beveled portion.

* * * * *